US011993910B2

(12) United States Patent
Lorenz et al.

(10) Patent No.: US 11,993,910 B2
(45) Date of Patent: May 28, 2024

(54) METHOD FOR PRODUCING AN INJECTION ANCHOR IN THE GROUND AND AUTOMATIC POST-GROUTING MACHINE FOR THE SAME

(71) Applicant: BAUER Spezialtiefbau GmbH, Schrobenhausen (DE)

(72) Inventors: Christian Lorenz, Schrobenhausen (DE); Daniel Brokemper, Krefeld (DE); Sebastian Romer, Stuttgart (DE)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 575 days.

(21) Appl. No.: 17/275,807

(22) PCT Filed: Aug. 13, 2019

(86) PCT No.: PCT/EP2019/071721
§ 371 (c)(1),
(2) Date: Mar. 12, 2021

(87) PCT Pub. No.: WO2020/064208
PCT Pub. Date: Apr. 2, 2020

(65) Prior Publication Data

US 2022/0049448 A1 Feb. 17, 2022

(30) Foreign Application Priority Data

Sep. 26, 2018 (EP) ..... 18196794

(51) Int. Cl.
*E02D 5/80* (2006.01)
*E02D 5/74* (2006.01)
*E02D 5/76* (2006.01)

(52) U.S. Cl.
CPC ..... *E02D 5/808* (2013.01); *E02D 5/74* (2013.01); *E02D 5/76* (2013.01); *E02D 5/80* (2013.01); *E02D 2250/003* (2013.01)

(58) Field of Classification Search
CPC .. E02D 5/808; E02D 5/76; E02D 5/80; E02D 3/12; E02D 2250/003; E02D 5/46;
(Continued)

(56) References Cited

U.S. PATENT DOCUMENTS 2,949,705 A * 8/1960 Carper ..... E04G 21/12 52/433
3,222,873 A * 12/1965 Williams ..... E02D 5/808 52/698
(Continued)

FOREIGN PATENT DOCUMENTS

CN 107447756 A 12/2017
DE 2050292 A1 * 5/1972 ..... E02D 5/54
(Continued)

OTHER PUBLICATIONS

Office Action mailed by the European Patent Office dated Nov. 12, 2020, which corresponds to European Patent Application No. 18 196 794.4-1002 and is related to U.S. Appl. No. 17/275,807.
(Continued)

*Primary Examiner* — Brian D Mattei
*Assistant Examiner* — Omar F Hijaz
(74) *Attorney, Agent, or Firm* — Studebaker & Brackett PC

(57) ABSTRACT

The invention relates to a method and a device for producing an injection anchor in the ground, wherein a bore is created in the ground, a hardening material for forming the anchor foot is injected by means of an injection member at least in a partial region of the bore, and after partial, not yet complete, hardening of the material a post-grouting medium
(Continued)

is introduced under pressure in a region of the anchor foot via a post-grouting member, by which medium the not yet completely hardened anchor foot is broken up. According to the invention, provision is made for an automatic post-grouting machine to be connected to the post-grouting member, by which machine the post-grouting medium for breaking up the not yet hardened anchor foot is automatically introduced into the post-grouting member at a freely specifiable time.

13 Claims, 1 Drawing Sheet

(58) Field of Classification Search
CPC ..... E02D 5/74; E21D 20/02; E21D 20/021; E21D 20/028; E21D 21/008; E04G 23/0211
See application file for complete search history.

(56) References Cited

U.S. PATENT DOCUMENTS 3,336,758 A * 8/1967 Williams ..... E21D 20/021 52/698
3,753,354 A * 8/1973 Bauer ..... E02D 5/808 405/259.5
4,744,193 A * 5/1988 Hatsuzaki ..... E02D 3/12 52/742.16
8,826,627 B2 * 9/2014 Hongo ..... E04C 5/165 52/742.16
2007/0286687 A1 * 12/2007 Melegari ..... E02D 5/30 405/239
2018/0066519 A1 3/2018 Faulkner et al.

FOREIGN PATENT DOCUMENTS

DE 2050292 A1 6/1972
DE 102009029892 A1 9/2011
EP 0218987 A2 4/1987
KR 20060019025 A * 8/2004 ..... E02D 3/12

OTHER PUBLICATIONS

International Search Report issued in PCT/EP2019/071721; dated Nov. 25, 2019.
International Preliminary Report on Patentability and Written Opinion issued in PCT/EP2019/071721; dated Mar. 23, 2021.

* cited by examiner

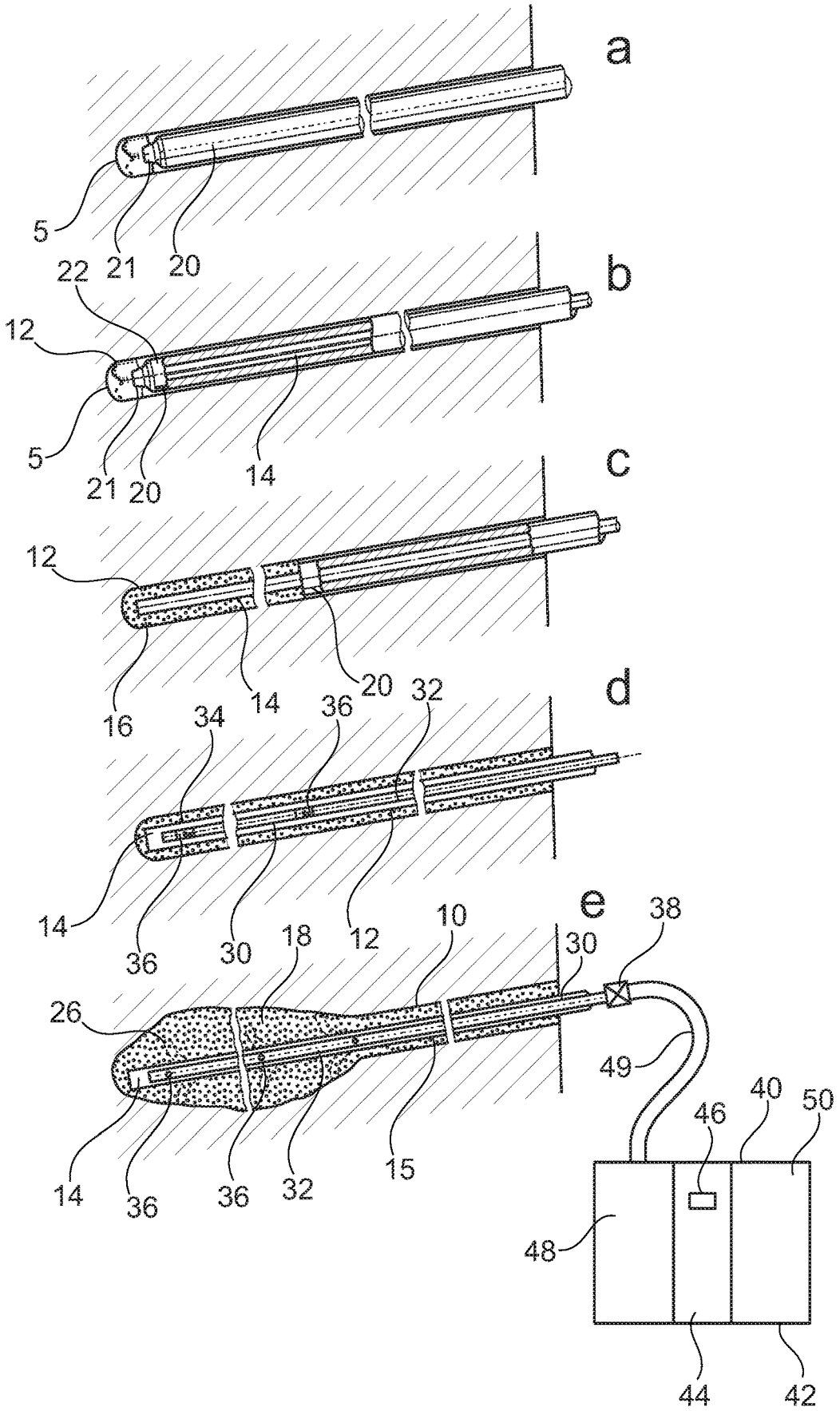
a
5
21
20
b
22
12
5
21
20
14
c
12
16
14
20
d
34
36
32
14
36
30
12
e
18
10
30
38
26
49
40
50
46
14
36
36
32
15
48
44
42

METHOD FOR PRODUCING AN INJECTION ANCHOR IN THE GROUND AND AUTOMATIC POST-GROUTING MACHINE FOR THE SAME

The invention relates to a method for producing an injection anchor in the ground, wherein a bore is created in the ground, a hardening material for forming an anchor foot is injected by means of an injection member at least in a partial region of the bore, and after partial, not yet complete, hardening of the material a post-grouting medium is introduced under pressure in a region of the anchor foot by way of a post-grouting member, by which medium the not yet completely hardened anchor foot is broken up, in accordance with the preamble of claim 1.

The invention furthermore relates to an automatic post-grouting machine for such a method, in accordance with claim 9.

A method for producing an injection anchor, also called grouted anchor, with a widened anchor foot is known from DE 2 050 292 A. In this case, first of all a bore is created in the ground, into which bore a tension member for the anchor is introduced. In an anchoring region of the tension member, an anchor foot is formed in the ground by injecting hardening construction material. By way of an injection tube, which is introduced into the bore together with the tension member, before the construction material for the anchor foot has hardened completely further hardening construction material is grouted in the anchoring region through the injection tube at high pressure. As a result, the partially hardened primary anchor foot created in the first step is broken up, and can thus be widened, in particular in the radial direction, to form a secondary anchor foot, by which stronger anchoring of the tension member can be achieved.

This method has been used very successfully for a long time. To break up the primary anchor foot, it is necessary for the material provided for forming the anchor foot to be partially, but not yet completely, hardened. A certain solidity is necessary so that the anchor foot can fracture and corresponding cracks and parts can form. On the other hand, the anchor foot must not yet be completely or largely hardened, since otherwise the pressure necessary for breaking up the anchor foot would be too high from an economic point of view, or could no longer be applied at all. Usually the length of time for the necessary initial hardening of the anchor foot is several hours, typically about one day.

Usually, on building sites the anchor foot is produced on a first day, while the post-grouting with the fracturing of the anchor foot is then carried out the following day. The result of this is that during a working week on a building site as a rule grouted anchors are produced from Monday to Thursday, with the post-grouting being carried out the following day. Since however there is usually no working on building sites on Saturdays and Sundays, no injection anchors with primary anchor feet are created on a Friday, since it would not be possible, or would be only hardly possible anyway, to carry out the post-grouting the following Monday, since because of the progressing hardening of the anchor foot it would no longer be able to be broken up reliably by a post-grouting medium.

In reality, thus with conventional building projects only four working days, namely Monday to Thursday, are available for producing an injection anchor with an anchor foot which is to be post-grouted.

The object of the invention is to offer a method for producing an injection anchor in the ground and a device therefor with which increased flexibility in terms of time is provided when producing injection anchors.

According to the invention, this object is achieved firstly by a method having the features of claim 1 and secondly with an automatic post-grouting machine having the features of claim 9. Preferred embodiments of the invention are given in the respective dependent claims.

The method according to the invention is characterised in that an automatic post-grouting machine is connected to the post-grouting member, by which machine the post-grouting medium for breaking up the not yet completely hardened anchor foot is automatically introduced into the post-grouting member at a freely specifiable time.

A fundamental concept of the invention is that a post-grouting of an anchor foot can be carried out without personnel by a special automatic post-grouting machine. In this case, the automatic post-grouting machine is connected by a line to the post-grouting member, with the post-grouting medium for breaking up the not yet hardened primary anchor foot being able to be introduced automatically into the post-grouting member. In this case, any time can be input into the automatic post-grouting machine, at which time the post-grouting medium is then introduced into the post-grouting member. The time for post-grouting may also be switched from a remote headquarters by way of a preferably wireless data connection or dependent on sensors which for instance ascertain a state of the primary anchor foot, such as solidity or residual moisture content etc., of the surroundings or other relevant parameters.

Thus a post-grouting can be carried out regardless of whether personnel are present, and hence also at weekends, on public holidays, in the morning hours or night hours. In particular, by using an automatic post-grouting machine now in principle on building sites the Friday can also be scheduled for producing injection anchors. This leads to improved utilisation of the machinery, an increase in the weekly output for injection anchors which are to be created, and a reduction in construction time. As a result, this leads to considerable cost benefits.

Depending on the type of production of the injection anchor, a tension member for the anchor is introduced into the bore during or after it has been created, it needing to be ensured in each case that the tension member is connected reliably to the anchor foot formed.

One preferred embodiment of the invention consists in that the post-grouting medium is a liquid, in particular water, or a gas, in particular compressed air, by which the anchor foot is broken up, and in that a hardenable medium is introduced temporally spaced into the broken-up anchor foot.

With this two-stage post-grouting, first of all breaking-up of the primary anchor foot by a non-hardening medium, in particular water or compressed air, takes place at the specified time. This first step may be carried out by the automatic post-grouting machine, with storage of water or compressed air, which is formed in particular from the ambient air, being possible without problems. The second step of post-grouting by introducing a hardening medium into the broken-up primary anchor foot can be carried out either likewise by the automatic post-grouting machine, which then has an additional storage means and optionally an additional pressure means for generating the pressure for the hardenable medium. Alternatively, the second step of post-grouting may be carried out non-automatically by personnel at a later time. Once the primary anchor foot has been broken up, the broken-up anchor foot parts may harden itself until the hardening medium is introduced.

It is particularly preferred according to one development of the invention for a hardenable medium to be used as post-grouting medium, in particular the hardening material for forming the anchor foot. In this case, therefore, the post-grouting is carried out in a single step, with the post-grouting medium possibly being in particular a cement suspension or another hardenable suspension. When using the same hardenable material as for forming the primary anchor foot, a particularly stable final secondary anchor foot can thus be produced.

There are in principle various process flows for producing the anchor member which are known from the prior art and are described and illustrated in particular in the document DE 2 050 292 A mentioned at the beginning. The invention covers all these basic process variants for producing an injection anchor, but with the step of automatic post-grouting. It is particularly preferable according to one embodiment of the invention that the injection member for injecting the hardenable material and a separate post-grouting member for injecting the post-grouting medium remain in the bore. Advantageously, the injection member and the post-grouting member may be introduced into the bore together with the tension member. Alternatively, the injection member could also be used as a post-grouting member for the post-grouting medium and/or a different hardenable medium for forming the secondary anchor foot.

In principle, the injection member may be a separate element which is introduced into the bore with or after the removal of the drilling tool. It is particularly advantageous according to one variant embodiment of the invention for the injection member to be designed as a drilling tool with which the bore in the ground is created. The injection member may at the same time or alternatively be a part of the tension member, so that an overall simple workflow is achieved.

One particularly expedient method variant furthermore consists in that the post-grouting member has at least one exit opening through which the post-grouting medium is introduced into the bore. The hose-like or tube-like post-grouting member, in the region of the anchor foot to be formed, may have a portion with a plurality of openings or with a reduced material thickness, which fractures in a defined manner upon introduction of the post-grouting medium at a specified pressure. As a result, the post-grouting medium can emerge into the surrounding region and break up the primary anchor foot or introduce a hardenable medium for forming the secondary anchor foot.

Depending on the method, in this case a suitable pressure is set. According to one embodiment of the invention, provision is made in a preferred manner for a pressure for introducing the post-grouting medium of at least 10 bar, preferably between 15 bar and 40 bar, to be set. In particular cases, lower or higher pressures may also be provided.

Furthermore, according to one refinement of the invention it is particularly advantageous for the automatic post-grouting machine to be provided with a control unit in which a time for carrying out the automatic post-grouting is input. The control unit may in this case have in particular a timeswitch, with which in particular a period of time or a defined time for carrying out the automatic post-grouting can be input. When the input time is reached, then the automatic post-grouting machine for introducing the post-grouting medium can be set into operation in the desired manner by way of the mechanical or preferably electronic control unit.

The control unit may in this case additionally be provided with an input means for inputting the necessary pressure, the filling quantity to be introduced and/or a limit pressure at which the post-grouting operation can be halted.

The device according to the invention is designed as an automatic post-grouting machine which is characterised in that a pressure means is provided which can be connected by a line to the post-grouting member and which is designed for introducing the post-grouting medium under pressure into the post-grouting member, and in that a control unit is provided in which a time for automatic introduction of the post-grouting medium into the post-grouting member is formed.

With the automatic post-grouting machine according to the invention, in particular the method previously described can be carried out and the associated advantages be obtained.

One preferred embodiment consists according to the invention in that at least one container for receiving the post-grouting medium is provided. The container may in this case also be a pressure vessel in which the medium, in particular compressed air, is stored under pressure. In principle, a plurality of, in particular two, containers may also be provided, so that for instance compressed air is stored in one container and the hardenable medium in another container.

The pressure means may be any suitable means for generating pressure, for instance a pressure storage vessel with compressed gas or a compression spring unit. It is particularly preferable according to one embodiment of the invention for the pressure means to have a pump and/or a compressor. As a result, the necessary pressure for introducing the post-grouting medium can be applied. Preferably the components of the automatic post-grouting machine are electrically operated. The automatic post-grouting machine may be provided with batteries for supplying power, or have a connection to an external current source. In principle, other power sources for operating the automatic post-grouting machine are also possible.

In principle, an individual automatic post-grouting machine may be provided for each individual post-grouting member. As a result, the automatic post-grouting machine may be designed to be very compact overall. One alternative and preferred embodiment of the invention may be seen as being that the automatic post-grouting machine is connected to a plurality of post-grouting members by way of a plurality of lines. With this arrangement, in particular a central automatic post-grouting machine may supply a plurality of post-grouting members with the post-grouting medium. The control unit may in this case be designed such that this takes place simultaneously for all the, or a plurality of, post-grouting members, or that the post-grouting operations are carried out on the individual post-grouting members in succession.

Below, the invention will be described further with reference to a preferred example of embodiment, which is illustrated schematically in the appended drawing.

In the sole FIGURE, the performance of a preferred variant embodiment of the method according to the invention is illustrated in five steps.

Here, in a step a) a bore 5 is formed in a ground or an approximately vertical wall region by means of a drilling tool 20. By way of a drill tip 21, a hardenable material 12 can be introduced into the bore 5 in order to form a primary anchor foot 16, as illustrated clearly in the steps b) and c).

The rod-shaped tension member 14 for forming the injection anchor 10 and also the rod-shaped injection member 22 may be arranged within the drilling tool 20, so that they can be introduced into the bore 5 already with the drilling tool 20. After reaching the desired depth, the outer drilling tool 20 can be withdrawn from the bore 5 again, with the cavity in the bore 5 being filled at least in regions with the hardenable material 12, as clearly illustrated in the steps c) and d). With this method, the drilling tool 20 serves simultaneously as an injection member 22 for injecting the hardenable material 12 for forming the primary anchor foot 16 and also optionally for forming a further region of the injection anchor 10.

According to the invention, a hose-shaped post-grouting member 30 with a hollow basic body 32 is introduced into the bore 5 with the tension member 14, as long as the hardenable material 12 is still in a soft, free-flowing state. At the soil-end end region of the basic body 32 of the post-grouting member 30 there is arranged, at least in portions, a post-grouting portion 34 which covers grouting openings 36 in the tubular basic body 32.

As clearly illustrated in step e), an automatic post-grouting machine 40 according to the invention is connected to the free end of the post-grouting member 30 which protrudes out of the ground by way of a connector 38 and a line 49.

The automatic post-grouting machine 40 has a box-like frame 42 with a control unit 44, at least one container 48 for receiving a post-grouting medium 26, and a pressure means 50 for generating a desired injection pressure. The control unit 44 is provided with a timeswitch 46, with which a time can be input at which, by means of the automatic post-grouting machine 40, post-grouting medium 26 from the container 48 can be automatically introduced into the post-grouting member 30 under pressure by means of the pressure means 50.

Due to the introduction of the post-grouting medium 26, which may in particular be identical to the hardenable material 12, at a specifiable time at which the primary anchor foot 16 is partially, but not yet completely, hardened, can be introduced into the bore 5. In this case, at a pressure of for example 15 bar, the one, or the plurality of, post-grouting portion(s) 34 on the post-grouting member 30 can be fractured, so that the exit openings 36 in the basic body 32 of the post-grouting member 30 are uncovered. The flowable post-grouting medium 26 can in this case penetrate into the region of the primary anchor foot 16, break it up and expand it to form an enlarged, approximately pear-shaped, secondary anchor foot 18. Once hardening is complete, a secondary anchor foot 18 of widened diameter is thus obtained, into which the tension member 14 is securely bonded, so that relatively high forces can be transferred into the ground by way of the tension member 14 and the widened secondary anchor foot 18.

In an upper region of the injection anchor 10, the tension member 14 may be surrounded by a cylindrical tube member 15.

After termination of the post-grouting, which can be carried out in particular without personnel at weekends, the automatic post-grouting machine 40 can be removed again by detaching the line 49 at the connector 38 and be provided for a further post-grouting operation.

The invention claimed is:

1. A method for producing an injection anchor in the ground, wherein a bore is created in the ground, a hardening material for forming a primary anchor foot is injected by means of an injection member at least in a partial region of the bore, and after partial, not yet complete, hardening of the material a post-grouting medium is introduced under pressure into a region of the primary anchor foot via a post-grouting member, by which medium the not yet completely hardened primary anchor foot is broken up and forms a secondary anchor foot having a size larger than the primary anchor foot, wherein an automatic post-grouting machine is connected to the post-grouting member, by which machine the post-grouting medium for breaking up the not yet hardened primary anchor foot is automatically introduced into the post-grouting member at a freely specifiable time, and the automatic post-grouting machine is provided with a control unit with a timeswitch, in which the freely specifiable time for carrying out the automatic post-grouting is input such that the automatic introduction of the post-grouting medium is carried out at the freely specified time without intervention by personnel.

2. The method according to claim 1, wherein the post-grouting medium is a liquid or a gas by which the primary anchor foot is broken up, and a hardenable medium is introduced temporally spaced into the broken-up anchor foot.

3. The method according to claim 1, wherein a hardenable medium is used as the post-grouting medium for forming the secondary anchor foot.

4. The method according to claim 1, wherein the injection member for injecting the hardenable material and the post-grouting member for injecting the post-grouting medium remain in the bore.

5. The method according to claim 1, wherein the injection member is a drilling tool with which the bore in the ground is created.

6. The method according to claim 1, wherein the post-grouting member has at least one exit opening, through which the post-grouting medium is introduced into the bore.

7. The method according to claim 1, wherein a pressure for introducing the post-grouting medium of at least 10 bar is set.

8. An automatic post-grouting machine for a method according to claim 1, wherein a pressure means is connected by at least one line to the post-grouting member and introduces the post-grouting medium under pressure into the post-grouting member.

9. The automatic post-grouting machine according to claim 8, wherein at least one container for receiving the post-grouting medium is provided.

10. The automatic post-grouting machine according to claim 8, wherein the pressure means comprises a pump or a compressor.

11. The automatic post-grouting machine according to claim 8, wherein the automatic post-grouting machine is connected to at least one post-grouting member by way of the at least one line.

12. The automatic post-grouting machine according to claim 7, wherein the pressure for introducing the post-grouting medium is set between 15 bar and 40 bar.

13. The method according to claim 2, wherein the liquid is water and the gas is compressed air.

* * * * *